United States Patent [19]

Anderson

[11] Patent Number: 4,961,478

[45] Date of Patent: Oct. 9, 1990

[54] CLAMPING DEVICE

[76] Inventor: Carl Anderson, c/o Alum-A-Pole Corporation-2589 Richmond Ter., Staten Island, N.Y. 10303

[21] Appl. No.: 326,385

[22] Filed: Mar. 21, 1989

[51] Int. Cl.[5] ..... E04G 5/04

[52] U.S. Cl. ..... 182/229; 24/486; 182/214; 248/245; 248/284

[58] Field of Search ..... 248/316.1, 316.5, 229, 248/230, 231.5, 218.4, 210, 245, 284; 211/89, 70.6; 403/330; 182/229, 214; 24/517, 486, 544, 339

[56] References Cited

U.S. PATENT DOCUMENTS

| | | | |
|---|---|---|---|
| 2,591,805 | 4/1952 | Gossett | 211/70.6 X |
| 2,962,079 | 11/1960 | Wilson | 24/517 X |
| 4,264,048 | 4/1981 | Silbernagel | 24/486 X |
| 4,348,790 | 9/1982 | Kuramoto et al. | 403/330 X |
| 4,363,388 | 12/1982 | London et al. | 24/517 X |
| 4,432,435 | 2/1984 | Anderson | 182/229 X |
| 4,445,657 | 5/1984 | Breckenridge | 248/316.5 X |
| 4,446,945 | 5/1984 | Anderson | 248/245 X |
| 4,497,412 | 2/1985 | Labelle | 211/89 X |

*Primary Examiner*—Ramon O. Ramirez
*Attorney, Agent, or Firm*—Helfgott & Karas

[57] ABSTRACT

A clamping device for securing a pole within a U-shaped yoke includes a clamp member pivotally supported on the yoke to open the latter so as to introduce therein an upright pole or to close the yoke to clamp the pole therewithin. The clamp member is provided with a pivotable locking member which has a hook insertable into a slot formed in a side wall of the yoke. A bolt threadingly passes through a hole in the clamp member and is terminated with a bearing plate which abuts the pole to clamp it within the yoke. The yoke is pivotally connected to an X-shaped brace which is fastened to a support surface to support the pole relative to this surface.

25 Claims, 2 Drawing Sheets

CLAMPING DEVICE

BACKGROUND OF THE INVENTION

The present invention relates to a clamping device, and more particularly to a clamp for securing a pump jack pole to a wall or roof brace or the like.

Upright poles are utilized in conventional scaffolding arrangements on which ride pump jacks supporting horizontal scaffolding platforms. Typically, such upright poles are made of aluminum and have a rubberized surface on one side. When assembling the scaffolding unit the upright poles must be secured to the wall or roof of the building on which the scaffolding is placed. One or two V or X-shaped braces are typically used for this purpose. The braces usually have a pair of legs coupled to the building. The head end of the brace is terminated with a U-shaped bracket which is pivotally connected to a U-shaped yoke which surrounds the pole to hold the pole in place. The yoke includes two side plates and a transverse plate member through which a bolt extends which is tightened by an outer wing nut to tighten the clamp onto the pole.

Clamping devices of the foregoing type are disclosed, for example, in applicant's U.S. Pat. Nos. 4,432,435 and 4,446,945.

The clamping device shown in applicant's U.S. Pat. No. 4,432,435 has a transverse plate member provided with a hook insertable into a slot of one of the side plates of the U-shaped yoke and a tooth insertable into a slot of another parallel side plate of the yoke. This caused some operational and installation difficulties in trying to manipulate the clamp into a closed position while simultaneously tightening the wing nut onto the pole.

SUMMARY OF THE INVENTION

Accordingly, it is an object of the present invention to provide an improved combination of a brace with a clamping device for supporting and clamping a pole in respect to a supporting surface.

Another object of the present invention is to provide a clamping device supported by a supporting brace for use in connection with securing pump jack poles to a support wall.

Still another object of the present invention is to provide a clamping device which ensures a safe and reliable clamping of the pole within a U-shaped yoke connected to the supporting brace.

Briefly, in accordance with the present invention, there is provided a clamping device for securing a pole within a U-shaped yoke pivotally connected to a brace which in turn is attachable to a support surface. The clamping device includes a clamp member pivotally connected to the yoke to pivot between an open position such that the pole can be inserted into the yoke and a closed position in which the pole is to be clamped within the yoke. An externally operated bearing plate is provided in the clamp member to press the pole against a bight portion of the U-shaped yoke. A pivotable locking member is provided on the clamp member. The locking member has a hook which is inserted into a slot formed in a side wall of the yoke to reliably lock the clamp member to the yoke.

In an embodiment of the invention, the locking member in the shape of crossed arms with one arm having the hook and one end insertable into the slot or cutout of the wall of the yoke, and an outwardly bent lever for manipulating the locking member to pivot it. The other cross arm has inwardly bent bars at its two ends, with the bars carrying a pivot for pivotally supporting the locking member on the clamp member.

In an embodiment, the clamp member is a U-channel with a base portion having a bore to receive therethrough a bolt carrying the bearing plate which acts on the pole inserted in the yoke. The two sides of the U-channel carries the pivot of the locking member.

In an embodiment of the invention, a holder for storing screws is provided on the external surface of one of the side portions of the yoke. The screws are used for fastening the brace to the support surface.

In an embodiment, the holder is made of a rubber material.

In an embodiment, the brace has an X-shaped configuration with a rod at its head. The rod passes through a rotatable bracket. The bight portion of the yoke is pivotally connected to the bracket.

The aforementioned objects, features and advantages of the invention will, in part, be pointed out with particularity, and will, in part, become obvious from the following more detailed description of the invention, taken in conjunction with the accompanying drawing, which form an integral part thereof.

DETAILED DESCRIPTION OF THE PREFERRED EMBODIMENT

Figure 1:
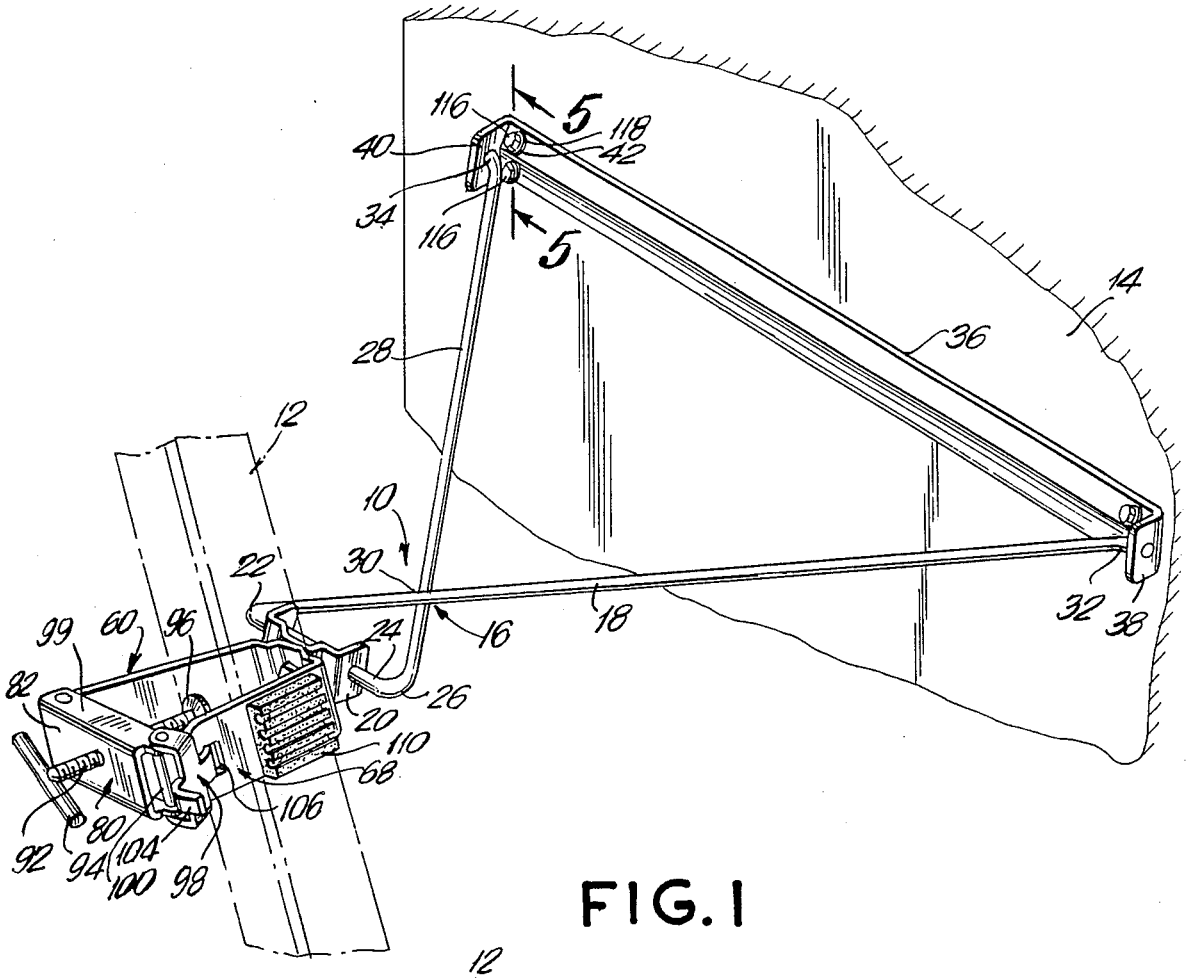
FIG. 1 is a perspective view showing an assembly of a brace with a clamping device for holding an upright pole with respect to a support surface, according to the present invention.

Referring now to FIG. 1, there is shown a perspective view of a brace 10 which serves to hold an upright pole 12 in spaced relationship from a support surface 14. The pole is typically a pump jack pole on which rides a pump jack supporting platform staging. Brace 10 comprises a rod frame 16 having an X-shaped configuration and including a first rod 18 which extends from the support surface towards a U-shaped bracket 20 at which it bends at 22 and continues as a rod-like head portion 24 extending approximately parallel to supporting surface 14 and passing through aligned holes in the bracket 20 whereby the bracket can rotate on the head portion 24. The rod continues into a second bend 26 and then becomes a second rod section 28 extending back to the supporting surface. Two rods 18 and 28 with the rod-like head portion 24 form the X-shaped configuration and cross each other at a point 30.

Each of rods 18 and 28 is terminated at its free end with an outwardly bent foot 32, 34, respectively. A connecting bar 36 which spans across the ends of rods 18 and 28 serves to interconnect the two feet 32 and 34. For this purpose, at opposing ends of connecting bar 36, there are provided tab portions 38, 40 extending upwardly from the connecting bar and having holes respectively receiving outwardly turned feet 32 and 34 to provide a pivotal connection between the X-shaped rod frame 16 and the connecting bar 36. Fastening holes 42 are provided in the connecting bar 36 near opposing distal ends thereof for receiving fastening screws 44, as shown in assembly in FIG. 5.

Figure 5:
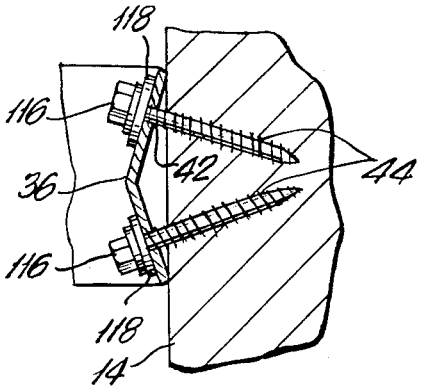
FIG. 5 is a cross-sectional view on line 5—5 of FIG. 1.

As best seen in FIG. 5, connecting bar 36 has a substantially V-shaped configuration which bows outwardly from the support surface 14 to which it is attached. Due to the outwardly bowing construction, holes 42 are angled with respect to the support surface 14 which would result in that screws 44 will be angled to the support surface 14. The angled insertion of screws 44 provides additional gripping of the screws to the support surface and thus enhances the security of the pole.

Figure 2:
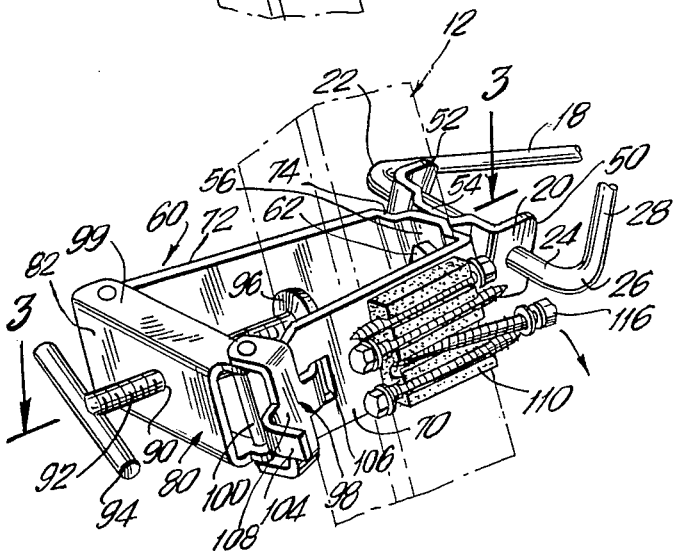
FIG. 2 is a perspective view of the clamping device, on an enlarged scale.
Figure 3:
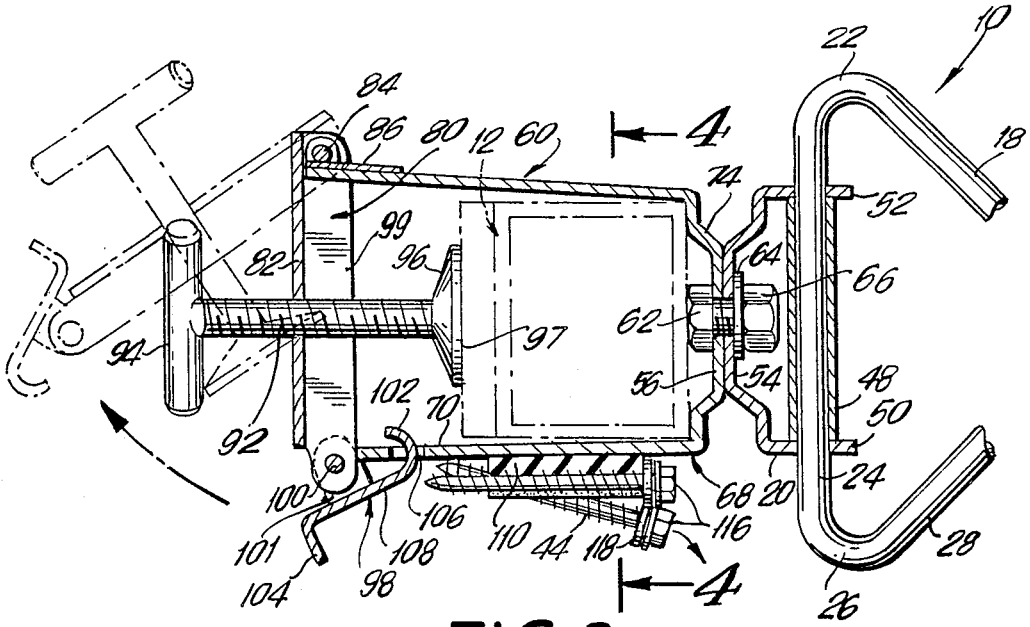
FIG. 3 is a cross-sectional side view of the clamping device along line 3—3 of FIG. 2.

As best seen in FIGS. 2 and 3, the rod-like head portion 24 of rod frame 16 extends through a sleeve or bushing 48 which is positioned between two parallel side walls 50, 52 of the U-shaped bracket 20 so that rod frame 16 can pivot about a first axis relative to the bracket 20. The latter at its light portion 5 is attached to the bight portion 56 of the U-shaped yoke of clamping device 60 by means of a bolt 62, washer 64 and nut 66. Nut 66 and washer 64 are loosened and bolt head 62 is inserted in a hole of the bight portion 56 with sufficient play to enable a pivoting motion of clamping device 60 relative to the brace 10 about a second axis which is perpendicular to the first axis.

The clamping device 60 includes a U-shaped yoke 68 having two opposing legs 70, 72 extending forwardly of and interconnected by the afore-mentioned bight portion 56. The bight portion includes a recessed step section 74. Bight portion 56 has a hole to receive bolt 62. The step section 74 provides a recess for receiving the bolt 62 to space it from the pole and for additional rigidity and support.

Pole 12 is retained in place by means of a closing member or clamp 80 which includes a substantially U-shaped channel 82 pivotally connected by means of a pivot pin 84 to a plate 86 which is rigidly secured, for example, by welding, to the outer side of the leg 72 of the yoke member 68 of clamping device 60. It is, of course, understood that plate 86 may be omitted and pivot pin 84 will be then arranged on leg 72. The plate 86 has two opposing ears which receive therebetween pivot pin 84. To insert pole 12 into the yoke 68 clamp 80 is pivoted outwards and the entire brace and clamping device assembly is placed laterally onto the upright pole 12.

The clamp 80 is provided with a central bore 90 extending therethrough. A bolt 92 which passes through the central bore of clamp 80 includes an externally operated wing nut 94 for manipulating the bolt, and a bearing plate 96 at the opposing internal end of the bolt. Bearing plate 96 is of a substantially frusto-conical configuration and has a flat end face 97 which bears against the pole 12 when the latter is inserted into the clamping device 60 and bolt 92 is moved inwardly in the direction to pole 12.

A locking member 98 is formed with two crossing leg portions and is pivotally connected to the end of the plate 82 by means of a pivot pin 100 extending between the two opposing walls 99 of plate 82. One leg portion of the locking member 98 has a hook 102 at one end thereof and a manipulating bent lever 104 at its opposing end. The other leg portion of the cross of locking member 98 has inwardly bent end bars 101 transversely extending therefrom and connected to the pivot pin 100. Leg 70 of the yoke 68 is formed with a slot or recess 106 which is of a substantially rectangular shape. Hook 102 has a substantially C-shaped configuration and is inserted into recess 106 upon pivoting of locking member 98 towards leg 70. Manipulating lever 104 is bent at right angles to an elongated center portion 108 of its leg. The hook 102 and manipulating lever 104 are bent or curved in opposite direction in respect to the elongated center portion 108 of the locking member so that by manipulating the lever 104 to pivot locking member 98 about pivot pin 100, the hook 102 is engaged in or disengaged from the slot 106 thus locking or unlocking clamp 80 onto the pole inserted in the clamping device 60. In FIG. 3 the closed position of clamp 80 is shown in solid line while its open position is shown in dotted line.

Figure 4:
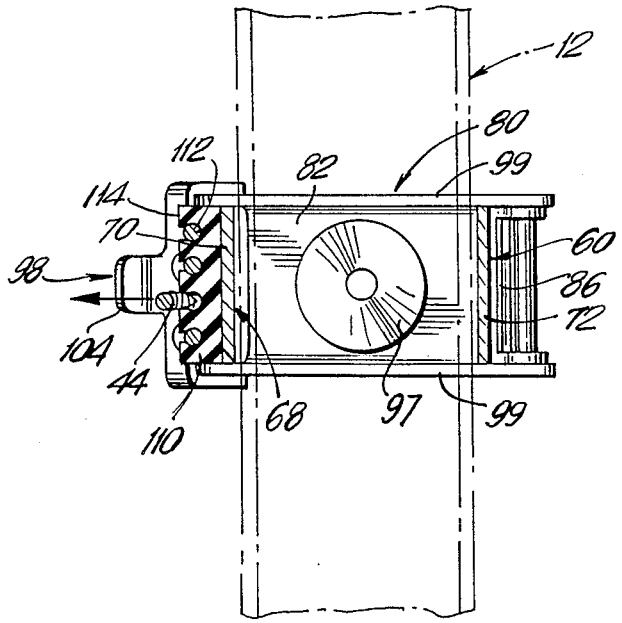
FIG. 4 is a cross-sectional view taken along line 4—4 of FIG. 3.

On the outer side of leg 70 of the yoke member 68 of the clamping device, there is provided a screw holder 110 also seen in FIG. 4. Screw holder 110 is somewhat resilient, typically of rubber, and is secured, by any suitable adhesive or other means to the outer surface of leg 70 of the yoke member 68. Holder 110 has a plurality of parallel elongated slots 112 which ar substantially circular in shape and correspond in diameter to screws 44. Slots 112 are narrowing towards an upper face 114 of holder 110 to define at that face two parallel inner surfaces the distance between which is smaller than the diameter of the circular part of each slot. Due to the resilient properties of holder 110 screws 44 can be easily snapped into or removed from slots 112 as shown in FIG. 3. Screws 44 are provided with hexagonal heads 116 and washers 118 and are placed in parallel slots 112 with hexagonal heads and screwed sections of adjacent screws facing in opposite directions as shown in FIG. 2, in order to facilitate insertion and removal of the screws. Rubber holder 110 serves as a storage for screws 44 which are removed from the holder only when brace 10 is to be connected at its connecting bar 36 to the support surface 14.

In operation, the brace 10 is connected to the pole by placing pole 12 within the U-shaped yoke member 68 and clamping it into place by pivoting clamp 80 to its closed position, then pivoting the locking member 98 to the locking position in which hook 102 is inserted into slot 106, and then tightening wing nut 94 of bolt 92 which moves bearing plate 96 to bear against pole 12. Upon tightening the wing nut 94, the U-shaped yoke 68 snugly holds the pole and the pole is pressed against the side shoulders of the bight portion 56 of the yoke member 68 whereby the pole will be tightly held within the clamping device 60.

It will be noted that the two legs 70, 72 of the yoke 68 flair outwardly from the bight portion 56 to permit easier insertion of the pole into the mouth of the yoke 68. Additionally, upon tightening the wind nut, these two legs can be slightly bound together in order to be sure that the C-shaped hook seats itself properly in the slot with the lowermost part of the C-shape engaging the slot to keep it secure. The pivoting of the locking member permits such slight adjustment for proper seating. It should be further appreciated that due to the provision o the pivotal locking member 98 safety of the clamping device is significantly increased because when the bolt 92 is moved inwardly to its end position hook 102 is securely held in slot 106 so that any accidental loosening as well as shifting of the locking member 98 are prevented. This additional safety is ensured by the locking member according to the present invention.

The connecting bar 36 is placed against the supporting surface 14, screws 44 are removed from its storage holder 112 and inserted through holes 42 provided at the opposing ends of the connecting bar of the brace and the bar secured in place.

As can be seen in FIGS. 1 and 2, in order to permit raising of the pole, its adjustment, etc, it is possible to scew the pole relative to the support surface 14. With connecting bar 36 placed against a vertical support surface pole 12 can be angled by rotating the pole about a horizontal axis. Such vertical scewing is important in utilizing pump jack poles.

Since the entire yoke assembly can pivot relative to brace 10 about two mutually perpendicular horizontal axes at 48 and 62, respectively the yoke assembly and its pivotal connection permit various relative movements between the vertical pole 12 and support surface 14. Also, pivotal movement between outwardly turned portions 32, 34 of the rod frame 16 of brace 10 and its connecting bar 36 provides for an additional orientation in positioning the pole.

The pivotable hook 102 in combination with the bolt 92 having the bearing plate pressing against the face of the pole provides for a safe lock of the clamp on the pole.

There has been disclosed heretofore the best embodiment of the invention presently contemplated. However, it is to be understood that various changes and modifications may be made thereto without departing from the spirit of the invention.

I claim:

1. In a combination of a brace for securing an upright pole to a support surface, with a clamping device for holding the pole, said brace comprising frame means pivotally connected to said clamping device about two mutually perpendicular axes, and a connecting bar attachable to the support surface;

said clamping device comprising a substantially U-shaped yoke member having two opposite lateral portions and a bight portion, said yoke member receiving the upright pole, a clamp member pivotally connected to one of said lateral portions of said yoke member to pivot between an open position in which said pole is inserted into said yoke member and a closed position to clamp said pole in said yoke member, means for pressing said pole against said bight portion of said yoke member, and a locking member engageable in the other of said lateral portions of said yoke member for locking said clamp member in said closed position, said locking member being pivotable on said clamp member between an open position to release said clamp member and permit pivoting of said clamp member to said open position thereof and a locking position to reliably lock said clamp member to said yoke member in said closed position, said pressing means being actuated externally of said yoke member to press said pole against said bight portion after said locking member has been pivoted into said locking position to securely engage the pole between said lateral portions, said bight portion and said pressing means and, at the same time, prevent any accidental release of said locking member from said yoke member.

2. A combination as in claim 1, wherein said yoke member has two side portions, one of said side portions being formed with a slot, said locking member being provided with a hook insertable in said slot in said locking position.

3. A combination as in claim 2, wherein said locking member includes a manipulating tab to pivot said locking member between its open and locking positions.

4. A combination as in claim 1, further including a substantially U-shaped bracket member for interconnecting said yoke member with said brace.

5. A combination as in claim 4, further comprising swivel means provided on said bracket member for pivotally connecting said yoke member to said brace.

6. A combination as in claim 5, wherein said bracket member has a bight portion facing the bight portion of said yoke member and two side portions, said swivel means including a first pivot member extending between said side portions of said bracket member and receiving a connecting rod of said brace to provide its pivoting about one of said axes, and a second pivot member coupling together said yoke member and said bracket member at their respective bight portions so as to provide pivoting of said brace about another of said axes.

7. A combination as in claim 6, wherein said first pivot member is a sleeve.

8. A combination as in claim 6, wherein said frame means of said brace includes a pair of legs defining an X-shaped structure having one end wider than the other, and said connecting rod closing off the narrowed end of the structure to form a smaller and a larger triangle, said connecting bar closing off said larger triangle.

9. A combination as in claim 1, wherein said lateral portions are parallel portions inter-connected by said bight portion, one of said lateral portions carrying a third pivot member for pivotally supporting said clamp member on said yoke member.

10. A combination as in claim 9, wherein said clamp member is a substantially U-shaped channel and has a base wall and two side walls, said side walls being connected at one end thereof to said pivot member to pivot therewith in respect to said yoke member.

11. A combination as in claim 10, wherein said side walls at other ends thereof support a further pivot member connected to said locking member to pivot therewith in respect to said clamp member.

12. A combination as in claim 11, wherein said locking member includes a C-shaped hook at one side thereof, and a bent tab at another side thereof, one of said side portions of said yoke member being provided with a slot receiving said C-shaped hook.

13. A combination as in claim 12, wherein said slot is substantially rectangular.

14. A combination as in claim 13, wherein said locking member has a substantially cross-shaped configuration having two arm portions, one arm portion forming said tab and said hook and another arm portion crossing said one arm portion and being formed with inwardly bent end tabs transversely extending from said another portion and being connected to said another pivot member.

15. A combination as in claim 10, wherein said base wall of said closing member is formed with a hole and wherein said pressing means comprise a bolt having a forward end threadingly passing through said hole into an interior of said yoke member, a bearing plate mounted on said forward end of said bolt for abutting the pole and pressing it towards said bight portion of said yoke member and a winged head mounted on a rearward end of said bolt and positioned externally of said first yoke member.

16. A combination as in claim 1, wherein said connecting bar comprises two bent foot portions transversely extending therefrom, each foot portion having an aperture, said frame means having rod portions each having an end pivotally received in each foot portion of said connecting bar.

17. A combination as in claim 16, wherein said connecting bar has a substantially V-shaped cross-section with its vertex extending away from the support surface.

18. A combination as in claim 16, wherein said connecting bar has fastening holes for receiving fastening means for sleeve retention of said brace to said support surface.

19. A combination as in claim 1, and further comprising holder means attached to said yoke member for storing fastening means for fastening said brace to said support surface.

20. A combination as in claim 19, wherein said fastening means are screws and said holder means is provided with parallel elongated grooves resiliently receiving and holding said screws.

21. A combination as in claim 20, wherein said holder means includes a block-shaped holder of a resilient material secured to a side portion of said yoke member and provided with said elongated grooves.

22. A combination as in claim 21, wherein said grooves are of a substantially circular configuration narrowing towards open ends thereof.

23. A combination as in claim 20, wherein said holder is made of rubber.

24. A combination as in claim 20, wherein said screws have hexagonal heads and are equipped with washers.

25. In a combination of a brace for securing an upright pole to a support surface, with a clamping device for holding the pole, said brace comprising frame means pivotally connected to said clamping device about two mutually perpendicular axes, and a connecting bar attachable to the support surface;

said clamping device comprising a substantially U-shaped yoke member having two opposite lateral portions and a bight potion, said yoke member receiving the upright pole, a clamp member pivotally connected to one of said lateral portions of said yoke member to pivot between an open position in which said pole is inserted into said yoke member and a closed position to clamp said pole in said yoke member, means for pressing said pole against said bight portion of said yoke member, and a locking member for locking said clamp member in said closed position, said locking member being pivotable on said clamp member between an open position to release said clamp member and permit pivoting of said clamp member to said open position thereof and a locking position in which said locking member is engaged in a slot of the other of said lateral portions of said yoke member so as to reliably lock said clamp member to said yoke member in said closed position, said pressing means being actuated externally of said yoke member to press said pole against said bight portion after said locking member has been pivoted into engagement with said slot to thereby securely engage the pole between said lateral portions, said bight portion and said pressing means and, at the same time, prevent any accidental release of said locking member from said yoke member.

* * * * *